US006916226B2

(12) United States Patent
Moloney et al.

(10) Patent No.: US 6,916,226 B2
(45) Date of Patent: Jul. 12, 2005

(54) CHEMICAL MECHANICAL POLISHING APPARATUS HAVING A STEPPED RETAINING RING AND METHOD FOR USE THEREOF

(75) Inventors: Gerard Stephen Moloney, Milpitas, CA (US); Huey-Ming Wang, Fremont, CA (US)

(73) Assignee: Ebara Technologies, Inc., Sacramento, CA (US)

( * ) Notice: Subject to any disclaimer, the term of this patent is extended or adjusted under 35 U.S.C. 154(b) by 63 days.

(21) Appl. No.: 10/319,258

(22) Filed: Dec. 13, 2002

(65) Prior Publication Data

US 2003/0224703 A1 Dec. 4, 2003

Related U.S. Application Data

(60) Provisional application No. 60/383,515, filed on May 28, 2002.

(51) Int. Cl.[7] ..... B24B 1/00; B24B 7/00

(52) U.S. Cl. ..... 451/36; 451/41; 451/59; 451/63; 451/288; 451/398

(58) Field of Search ..... 451/36, 41, 59, 451/285, 287, 288, 289, 290, 385, 397, 398, 402

(56) References Cited

U.S. PATENT DOCUMENTS

| | | | | |
|---|---|---|---|---|
| 6,089,961 A | * | 7/2000 | Cesna et al. | 451/285 |
| 6,224,472 B1 | * | 5/2001 | Lai et al. | 451/398 |
| 6,267,655 B1 | * | 7/2001 | Weldon et al. | 451/307 |
| 6,419,567 B1 | * | 7/2002 | Glashauser | 451/259 |
| 6,454,637 B1 | * | 9/2002 | Gotkis | 451/287 |
| 6,602,116 B1 | * | 8/2003 | Prince | 451/51 |
| 6,716,299 B1 | * | 4/2004 | Gotkis et al. | 156/345.14 |

* cited by examiner

*Primary Examiner*—Timothy V. Eley
(74) *Attorney, Agent, or Firm*—Squire, Sanders & Dempsey; Aaron Wininger

(57) ABSTRACT

A chemical mechanical processing apparatus includes a polishing pad capable of polishing a substrate; a stepped retaining having an inner side, a bottom side, and an open region, the open region extending radially outward from the inner side and upward from the bottom side, the open region providing space for pad rebound, the open region further having a plurality of tips to hold a substrate in position during rotation of the substrate against the polishing pad, the stepped retaining ring capable of rotating the substrate against the polishing pad; and a dispenser capable of dispensing a slurry onto the pad.

39 Claims, 6 Drawing Sheets

CHEMICAL MECHANICAL POLISHING APPARATUS HAVING A STEPPED RETAINING RING AND METHOD FOR USE THEREOF

PRIORITY REFERENCE TO PRIOR APPLICATIONS

This application claims benefit of and incorporates by reference patent application Ser. No. 60/383,515, entitled "Stepped Retaining Ring," filed on May 28, 2002, by inventors Gerard Moloney and Huey-Ming Wang.

TECHNICAL FIELD

This invention relates generally to chemical mechanical polishing (CMP), and more particularly, but not exclusively, provides a chemical mechanical polishing apparatus having a stepped retaining ring and method for use thereof.

BACKGROUND

CMP is a combination of chemical reaction and mechanical buffing. A conventional CMP system includes a polishing head with a retaining ring that holds and rotates a substrate (also referred to interchangeably as a wafer) against a pad surface rotating in the opposite direction or same direction. The pad can be made of cast and sliced polyurethane (or other polymers) with a filler or a urethane coated felt.

During rotation of the substrate against the pad, a slurry of silica (and/or other abrasives) suspended in a mild etchant, such as potassium or ammonium hydroxide, is dispensed onto the pad. The combination of chemical reaction from the slurry and mechanical buffing from the pad removes vertical inconsistencies on the surface of the substrate, thereby forming an extremely flat surface.

However, in CMP systems using retaining rings, uniform polishing of the substrate surface from the center of the substrate to the edge of the substrate is difficult to achieve. In particular, during CMP, applied down forces will cause the pad material to deform at the edge of the substrate, which leads to increased removal at the edge of the substrate and therefore a non-flat surface.

FIG. 1A is a block diagram illustrating a cross section of a prior art retaining ring, substrate and pad wherein uniform polishing of the substrate is not achievable. Retaining ring 30 is cylindrical in shape and holds substrate 40 in place during CMP. The retaining ring 30 includes smooth lower surface 32 for contacting a polishing pad during CMP, an inner surface 34 for retaining a substrate, an outer surface 36, a top surface 38 and a topper surface 50 that essentially caps the hollow region of the retaining ring 30. During CMP, frictional force between the substrate surface and a polishing pad 10 will push substrate 40 towards the trailing edge 45 of the retaining ring. The retaining ring 30, in addition to functioning to hold the substrate 40 in place, functions to press the pad 110 in a lateral motion during the polishing processes. The force on the inner surface 34 of the retaining ring 30 at the trailing edge 45 generates increased pressure on the pad 110 and causes the pad 110 to "flow" and be deformed toward the edge of the substrate, which leads to fast edge removal.

Therefore, a system and method for reducing edge removal and generating a more uniformly flat surface are needed.

SUMMARY

The present invention provides a CMP apparatus having a stepped retaining ring. The retaining ring is a ring having an inner diameter slightly larger than the diameter of a substrate. The inner edge of the retaining ring is stepped, i.e., the inner edge of the retaining ring includes an open region having a height equal to about the height of the substrate with a uniform depth that can range from, for example, about two mm to about twelve mm. In addition, the open region includes tips that extend to the inner edge of the retaining ring and hold a substrate in place during CMP. The open region can include three or more tips that are evenly or oddly spaced within the open region. For example, the open region may include four tips spaced at 90° increments. The open region reduces deformity of the pad at the edge of the substrate by enabling the pad deformity to occur at the open region instead of at the edge of the substrate. Accordingly, the removal rate at the outer edge of the substrate is more uniform with the removal rate at other areas of the substrate, thereby leading to a more uniformly flat substrate surface.

The present invention further provides a method for CMP. The method comprises: retaining a substrate with the stepped retaining ring; dispensing slurry on the pad; and rotating the retaining ring against the pad in opposite directions or in the same direction. Note that the dispensing and rotating can be done simultaneously and continuously in an embodiment of the invention.

Accordingly, the apparatus and method advantageously enables the formation of a flat substrate surface by providing an open region in the retaining ring for pad rebound.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DETAILED DESCRIPTION OF THE ILLUSTRATED EMBODIMENTS

The following description is provided to enable any person skilled in the art to make and use the invention, and is provided in the context of a particular application and its requirements. Various modifications to the embodiments will be readily apparent to those skilled in the art, and the principles defined herein may be applied to other embodiments and applications without departing from the spirit and scope of the invention. Thus, the present invention is not intended to be limited to the embodiments shown, but is to be accorded the widest scope consistent with the principles, features and teachings disclosed herein.

Figure 1A:
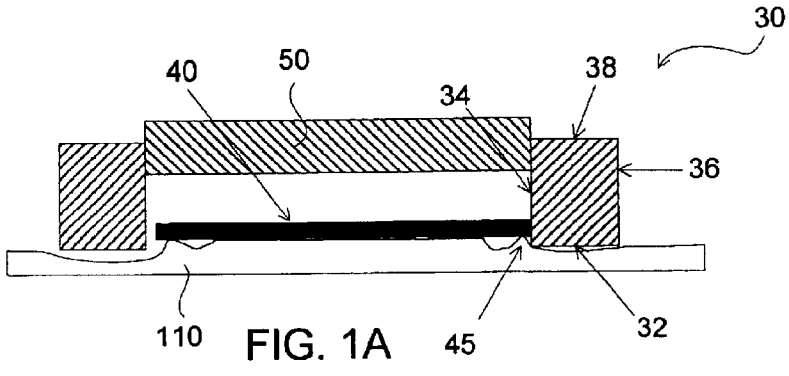
FIG. 1A Prior Art
FIG. 1A is a block diagram illustrating a cross section of a prior art retaining ring, substrate and pad.
Figure 1B:
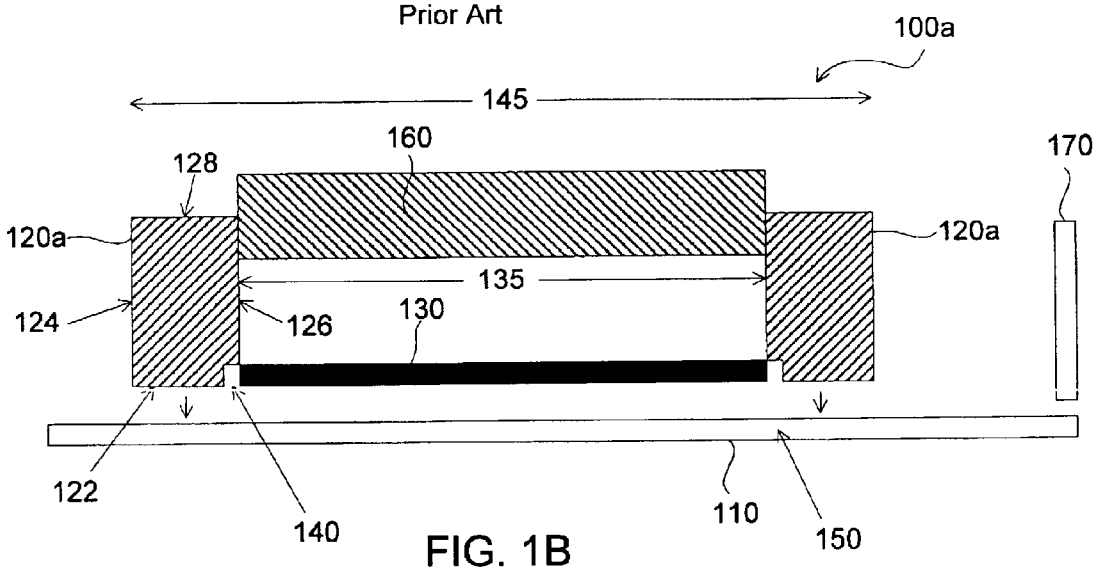
FIG. 1B is a block diagram illustrating a cross-sectional side view of a retaining ring, substrate and pad according to an embodiment of the invention.

FIG. 1B is block diagram illustrating a cross-sectional side view of a polishing apparatus 100*a* for substantially uniformly polishing wafers in accordance with a first embodiment. The polishing apparatus 100*a* includes a retaining ring 120*a*, a slurry dispenser 170, and a polishing pad 110. Retaining ring 120*a* is a cylindrically shaped structure that has a substantially smooth lower surface 122 for contacting the polishing pad 110 during CMP; an inner surface 126 for retaining a substrate 130 using tips 200 (FIG. 2); an outer surface 124 and a top surface 128. The retaining ring 120*a* may also include a topper surface 160 that essentially caps the hollow region of the retaining ring 120*a*. Substrate 130 can include silicon surfaces, metal films, oxide films, and other types of films on surfaces. The polishing pad 110 is made of polyurethane or other polymer materials (with or without chemicals or abrasives embedded) and with or without any grooves or holes on their polishing surfaces.

The retaining ring 120*a* includes a step-shaped detent around portions or all of the corner edge of inner surface 126 and lower surface 122, thereby creating one or more open regions 140. Each open region 140 has a width of, for example, about 2 mm to 8 mm depending on the embodiment. The open region 140 provides a region for pad 110 to rebound or exert pressure instead of rebounding against substrate 130. In an embodiment of the invention, the retaining ring 120*a* has an inner diameter 135 (i.e., the diameter of the hollow region of retaining ring 120*a*) of, for example, about one to two mm larger than that of a substrate 130. For example, a retaining ring 120*a* for a 200 mm substrate 130 would have an inner diameter of about 201 to 202 mm. The retaining ring 120*a* has an outer diameter 145 (i.e., the diameter from the outer surface 124) of, for example, about 30 mm to 75 mm larger than that of the substrate 130. For example, a retaining ring for a 300 mm substrate 130 would have an outer diameter of about 330 to. 375 mm. The retaining ring 120*a* has a height of about a substrate, or higher, for example, 7.5 mm. The retaining ring 120*a* may be made of a polymer such as PPS (polyphenylene Sulfide), PEEK (polyetherketone), or Ertalyte TX (a filled polyester).

Figure 2:
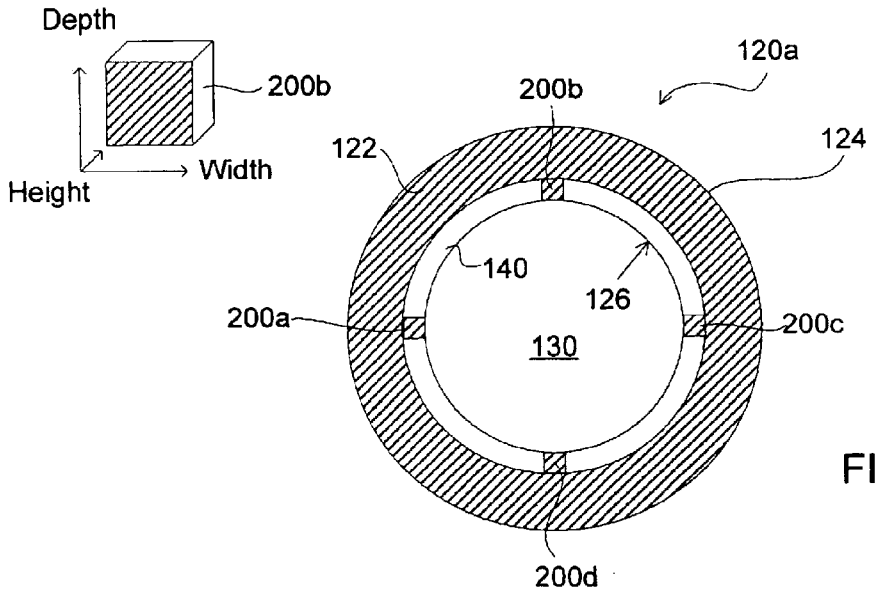
FIG. 2 is a block diagram illustrating a bottom view of the retaining ring of FIG. 1B.

During CMP, retaining ring 120*a* retains substrate 130 between tips 200*a*, 200*b*, 200*c* and 200*d* (FIG. 2). The retaining ring 120*a* is lowered onto polishing pad 110, which rotates relative to retaining ring 120*a*. In one embodiment, polishing pad 110 rotates in one direction and retaining ring 120*a* rotates in the opposite direction. It will also be appreciated that the pad 110 may be stationary while the retaining ring 120*a* rotates substrate 130 against pad 110. Alternatively, the retaining ring 120*a* may be stationary and the pad 110 may rotate against the retaining ring holding the substrate 130. Further, the rotation may be off center.

In addition, during rotation of the retaining ring 120*a* and the polishing pad 110, a slurry of silica and/or other abrasives suspended in a mild etchant is dispensed from a dispenser 170 onto the pad 110. In an embodiment of the invention, the slurry can include any commercialized fumed and colloidal silica slurries. Due to friction, the pad 110 may deform, giving the pad 110 an upward slope at the trailing edge 150. This upward slope, in contrast to conventional CMP systems, does not exert extra pressure against substrate 130 but instead deforms into open region 140. Accordingly, a CMP system using retaining ring 120*a* enables achieving a uniformly flatter surface on substrate 130 as compared to conventional CMP systems.

FIG. 2 is a block diagram illustrating a bottom view of the retaining ring 120*a* (FIG. 1B) and substrate 130. The retaining ring 120*a* includes a bottom surface 122 (FIG. 1B), an outer surface 124 and an inner surface 126. Extending radially outward for several millimeters from inner surface 126 and extending upwards for several millimeters (in another embodiment, to the approximate height of a substrate) from bottom surface 122 (FIG. 1B) is an open region 140 for providing a space for the pad 110 to rebound during rotation. Open region 140 is interrupted by four tips 200, namely, tip 200*a*, tip 200*b*, tip 200*c*, and tip 200*d*, which extend to inner surface 126. Each tip 200*a*, 200*b*, 200*c*, and 200*d* each have a width of up to several millimeters, e.g., 20 millimeters, a depth of up to about eight millimeters, and a height equal to about the height of a substrate, e.g., about 0.725 $\mu$m, or higher. The four tips 200 operate to hold the substrate 130 in place during rotation. In this embodiment, the four tips 200 are spaced at 90° intervals.

It will be appreciated that retaining ring 120*a* can include different numbers of tips 200. For example, retaining ring 120*a* may include three tips spaced at 120° intervals or five tips spaced at 72° intervals. Further, the tips 200 may be spaced an uneven intervals. For example, if retaining ring 120*a* includes five tips, the intervals may include 80°, 49°, 110°, 89°, and 32°. Further, tip size in relation to retainer ring 120*a* size may vary.

Figure 3:
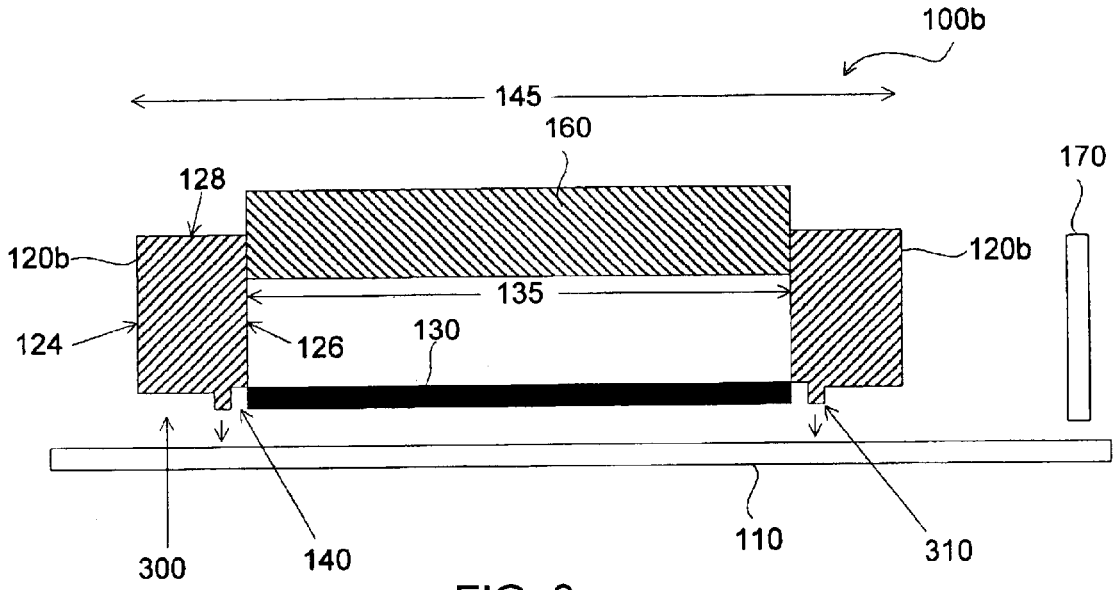
FIG. 3 is a block diagram illustrating a cross-sectional side view of a retaining ring, substrate and pad according to a second embodiment of the invention.

FIG. 3 is block diagram illustrating a cross-sectional side view of a polishing apparatus 100*b* for substantially uniformly polishing wafers in accordance with a second embodiment. The polishing apparatus 100*b* includes a retaining ring 120*b*, a slurry dispenser 170, and a polishing pad 110. Retaining ring 120*b* is substantially similar to retaining ring 120*a* but includes a second open region 300, which provides additional volume for pad 110 to rebound. In this embodiment, retaining ring 120*b* is a cylindrically shaped structure having an inner surface 126 for retaining a substrate 130 using tips 200 (FIG. 4); an outer surface 124 and a top surface 128. The retaining ring 120*b* may also include a topper surface 160 that essentially caps the hollow region of the retaining ring 120*b*.

The retaining ring 120*b* includes a step-shaped detent around portions or all of the corner edge of inner surface 126 and lower surface 122, thereby creating one or more open regions 140. Further, retaining ring 120*b* includes a second step-shaped detent around portions or all of the corner edge of outer surface 124 and bottom surface 122 thereby creating one or more open regions 300. Each open region 140 has a width of, for example, about 2 mm to about 12 mm depending on the embodiment. The open regions 140 and 300 provide a volume for pad 110 to rebound or exert pressure instead of rebounding against substrate 130. In an embodiment of the invention, the retaining ring 120*b* has an inner diameter 135 (i.e., the diameter of the hollow region of retaining ring 120*b*) of, for example, about one to two mm larger than that of a substrate 130. For example, a retaining ring 120*b* for a 200 mm substrate 130 would have an inner diameter of about 201 to 202 mm. The retaining ring 120*b* has an outer diameter 145 (i.e., the diameter from the outer surface 124) about 30 mm to about 75 mm larger than that of the substrate 130. For example, a retaining ring for a 300 mm substrate 130 would have an outer diameter of about 330 to about 375 mm. The retaining ring 120*b* has a height of about 7.5 mm. The retaining ring 120*b* may be made of a polymer such as PPS (polyphenylene Sulfide), PEEK (polyetherketone), or Ertalyte TX (a filled polyester).

Figure 4:
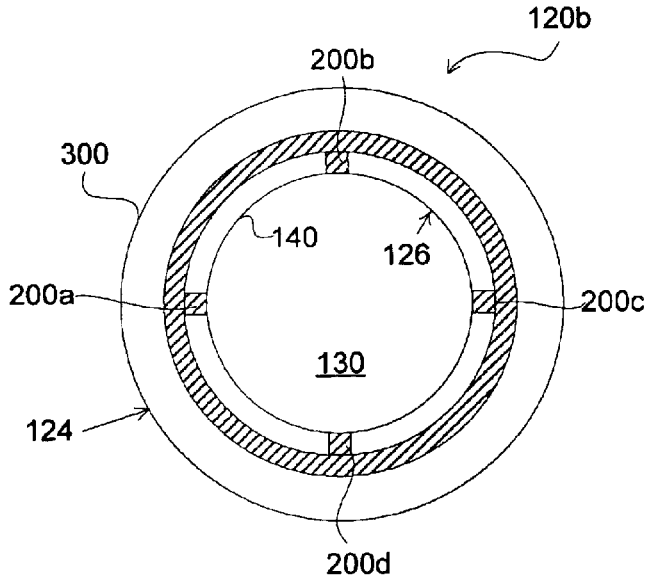
FIG. 4 is a block diagram illustrating a bottom view of the retaining ring of FIG. 3.

During CMP, retaining ring 120*b* retains substrate 130 between tips 200*a*, 200*b*, 200*c* and 200*d* (FIG. 4). The retaining ring 120*b* is lowered onto polishing pad 110, which rotates relative to retaining ring 120*b*. In one embodiment, polishing pad 110 rotates in one direction and retaining ring 120*b* rotates in the opposite direction. It will also be appreciated that the pad 110 may be stationary while the retaining ring 120*b* rotates substrate 130 against pad 110. Alternatively, the retaining ring 120*b* may be stationary and the pad 110 may rotate against the retaining ring holding the substrate 130. Further, the rotation may be off center.

In addition, during rotation of the retaining ring 120*b* and the polishing pad 110, a slurry of silica suspended in a mild etchant is dispensed from a dispenser 170 onto the pad 110 as discussed above in conjunction with FIG. 1B. Due to applied down forces, the pad 110 may deform, giving the pad 110 an upward slope at the trailing edge 150. This upward slope, in contrast to conventional CMP systems, does not exert extra pressure against substrate 130 but instead deforms into open region 140 and open region 300. The open region 300 of the retaining ring 120*b* may also retain or transport slurry better than traditional retaining rings. Slurry may also be transported through the retaining ring 120*b* on to the polishing pad 110 in the open region 300. Accordingly, a CMP system using retaining ring 120*b* enables achieving a uniformly flatter surface on substrate 130 as compared to conventional CMP systems.

FIG. 4 is a block diagram illustrating a bottom view of the retaining ring 120*b* (FIG. 3) and substrate 130. The retaining ring 120*b* includes four tips 200, namely tip 200*a*, tip 200*b*, tip 200*c* and tip 200*d*, a first open region 140 and a second open region 300. Each tip 200*a*, 200*b*, 200*c*, and 200*d* each have a width of up to several millimeters, e.g., 20 millimeters, a depth of up to about twelve millimeters, and a height equal to about the height of the acceptable wear of the retaining ring 120*b* plus a height to allow the pad 110 to rebound, or higher. First open region 140 extends radially outwards from inner surface 126 and upwards from bottom surface 310. Second open region 300 extends radially inwards from outer surface 124 and upwards from bottom surface 310. As discussed above, it will be appreciated that the number of tips 200 in retaining ring 120*b* can vary. For example, retaining ring 120*b* can include an even or odd number of tips that are evenly or unevenly spaced. For instance, retaining ring 120*b* may include three tips spaced at 120° intervals or at uneven intervals. Further, retaining ring 120*b* may include more than four tips that are spaced at even or uneven intervals, or as a single tip that follows the entire circumference of the substrate.

Figure 5A:
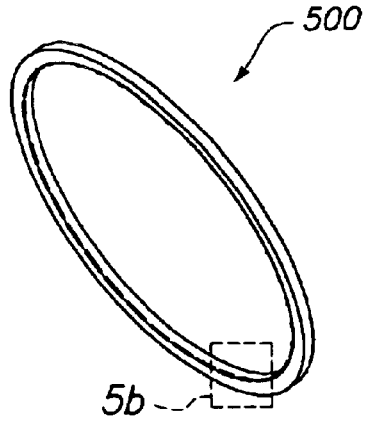
FIGS. 5*a*, 5*b* and 5*c* are perspective views of a retaining ring according to a third embodiment of the invention.
Figure 5B:
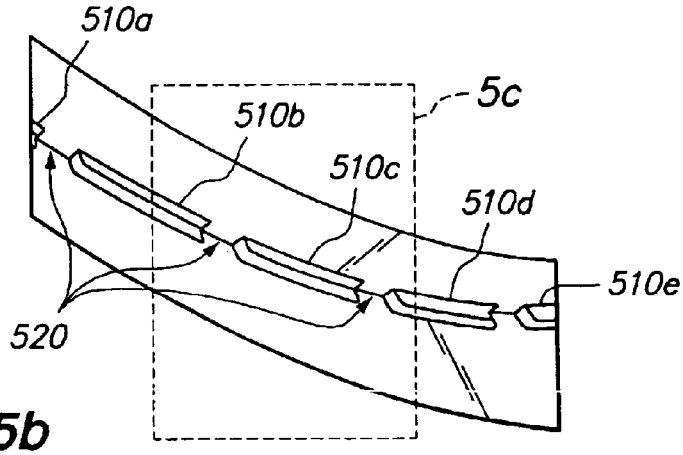
Figure 5C:
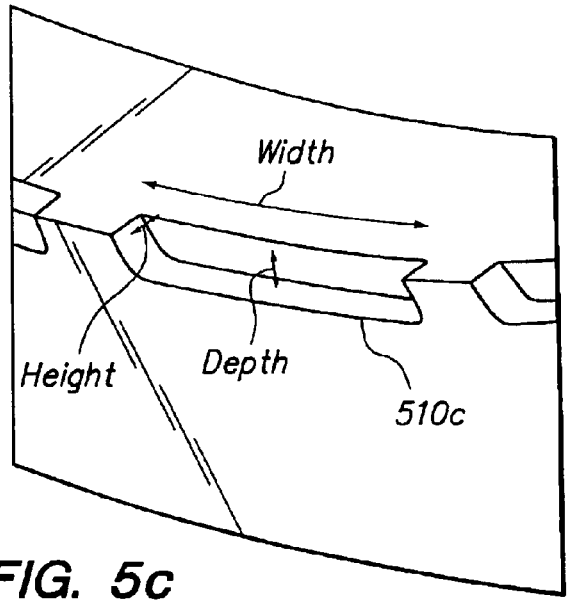

FIGS. 5*a*, 5*b* and 5*c* are perspective views of a retaining ring 500 according to a third embodiment of the invention. Retaining ring 500 includes a plurality of tips 510 (e.g., 510*a–e*) for holding a substrate 130 in place during CMP. In between each tip 510 is an open region 520 for providing space for pad 110 to rebound instead of rebounding (e.g., applying excess pressure) to the edge of a substrate. Each open region 520 between two adjacent tips 510 can be, for example, severfal millimeters in length or longer.

Each tip 510 has a width of up to several millimeters, e.g., 20 millimeters, a depth of up to about twelve millimeters, and a height equal to about the height of the acceptable wear of the retaining ring 500 plus a height to allow the pad 110 to rebound. It will be appreciated that the depth, width and height of the tips 510 can vary as long as each has sufficient depth, width and height to sufficiently hold a substrate substantially in place during CMP. It will also be appreciated that the tips 510 do not need to be of the same height of the substrate. The tips 510 need only sufficient height to maintain a substrate substantially in place during CMP.

Figure 6:
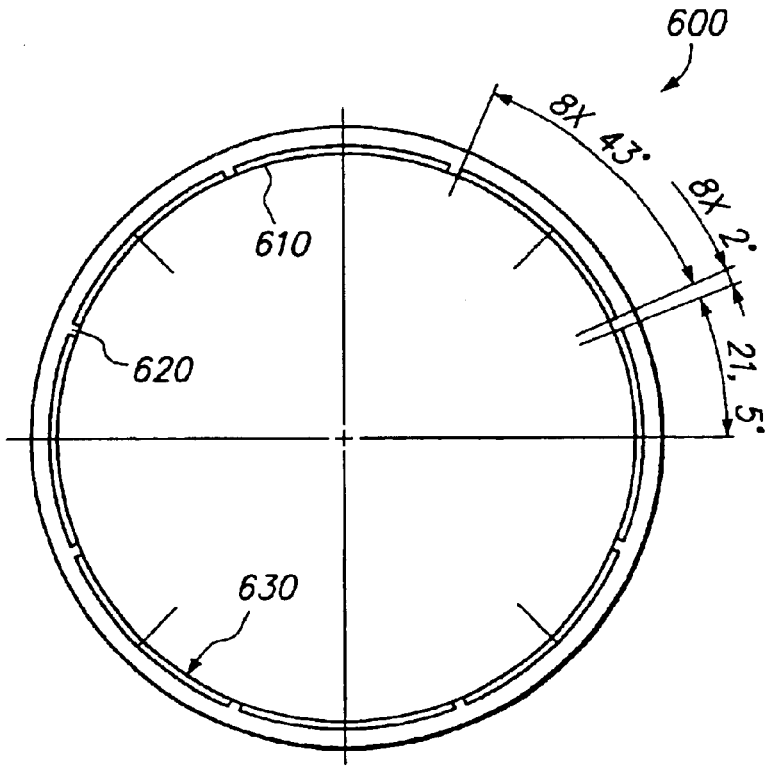
FIG. 6 is a block diagram illustrating a bottom view of a retaining ring according to a fourth embodiment of the invention.

FIG. 6 is a block diagram illustrating a bottom view of a retaining ring 600 according to a fourth embodiment of the invention. The retaining ring 600 is a cylindrically shaped structure and has an inner surface 630. In this example, retaining ring 600 has eight tips 620 each of a depth of about 4 mm leaving an open region 610 for pad 110 to rebound. Tips 620 can each have a width of up to several millimeters, e.g., 20 millimeters, and a height equal to about the of the acceptable wear of the retaining ring 600 plus a height to allow the pad 110 to rebound, or higher. The open region 610 extends radially outward from an inner surface 630 and upwards from a bottom surface, thereby forming a step-like structure. The tips 620 are spaced at intervals of 45° within the open region 610. It will be appreciated that the tips 620 can also be spaced at uneven intervals as long as they are positioned to substantially hold in place a substrate during CMP.

Figure 7:
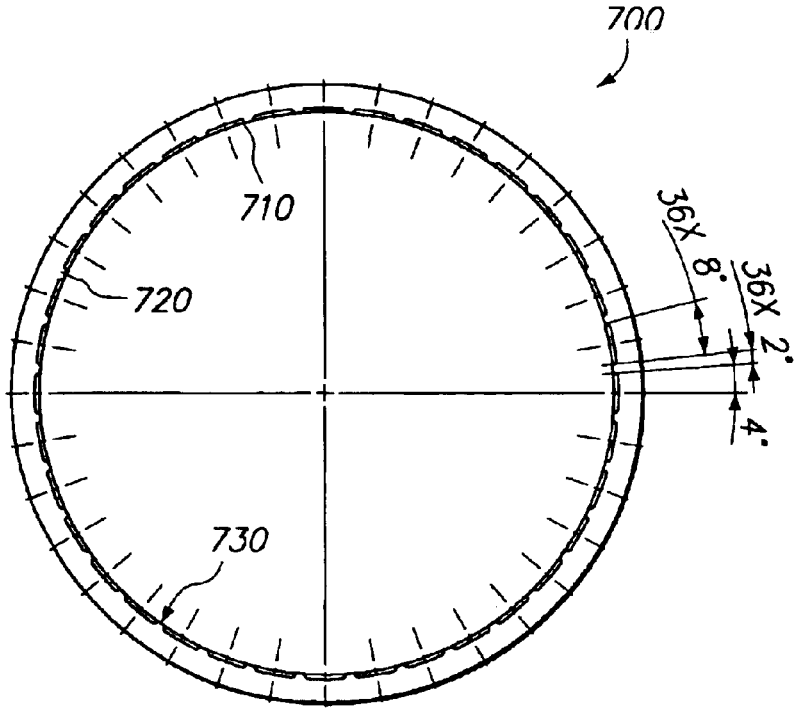
FIG. 7 is a block diagram illustrating a bottom view of a retaining ring according to a fifth embodiment of the invention.

FIG. 7 is a block diagram illustrating a bottom view of a retaining ring 700 according to a fifth embodiment of the invention. The retaining ring 700 is a cylindrically shaped structure and has an inner surface 730. In this example, retaining ring 700 has thirty-six tips 720 each of a depth of 2 mm leaving an open region 710 for pad 110 to rebound. Tips 720 can each have a width of up to several millimeters, e.g., 20 millimeters, and a height equal to about the thickness of the acceptable wear of the retaining ring 700 plus a height to allow the pad 110 to rebound, or higher. The open region 710 extends radially outward from an inner surface 730 and upwards from a bottom surface, thereby forming a step-like structure. The tips are spaced at intervals of 10°. It will be appreciated that the tips 720 can also be spaced at uneven intervals as long as they are positioned to substantially hold in place a substrate during CMP.

Figure 8:
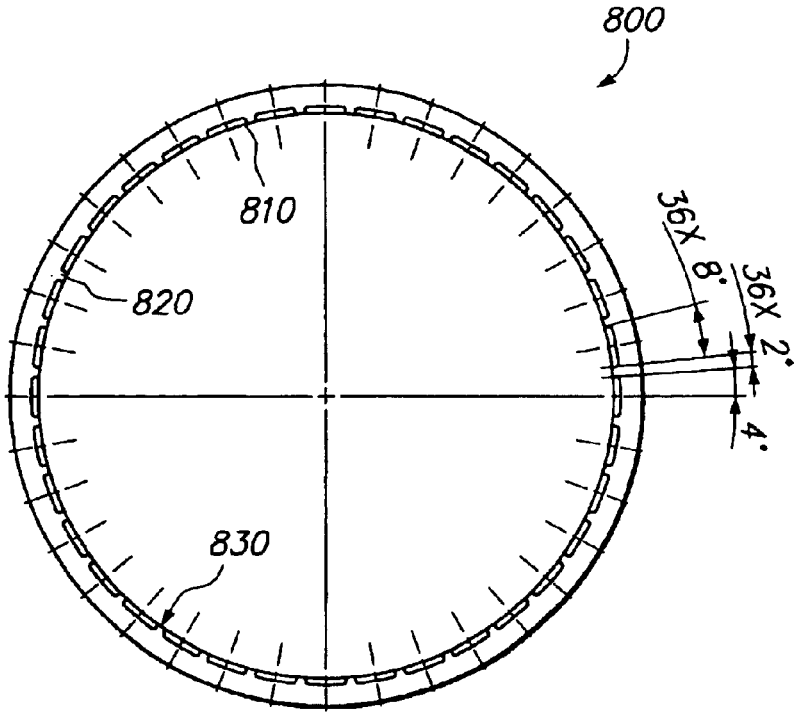
FIG. 8 is a block diagram illustrating a bottom view of a retaining ring according a sixth embodiment of the invention.

FIG. 8 is a block diagram illustrating a bottom view of a retaining ring 800 according to a sixth embodiment of the invention. The retaining ring 800 is a cylindrically shaped structure and has an inner surface 830. In this example, retaining ring 800 has thirty-six tips 820 each of a depth of 4 mm leaving an open region 810 for pad 110 to rebound. Tips 820 can each have a width of up to several millimeters, e.g., 20 millimeters, and a height equal to about the thickness of the acceptable wear of the retaining ring 800 plus a height to allow the pad to rebound, or higher. The open region 810 extends radially outward from an inner surface 830 and upwards from a bottom surface, thereby forming a step-like structure. The tips are spaced at intervals of about 13.85°. It will be appreciated that the tips 820 can also be spaced at uneven intervals as long as they are positioned to substantially hold in place a substrate during CMP.

Figure 9:
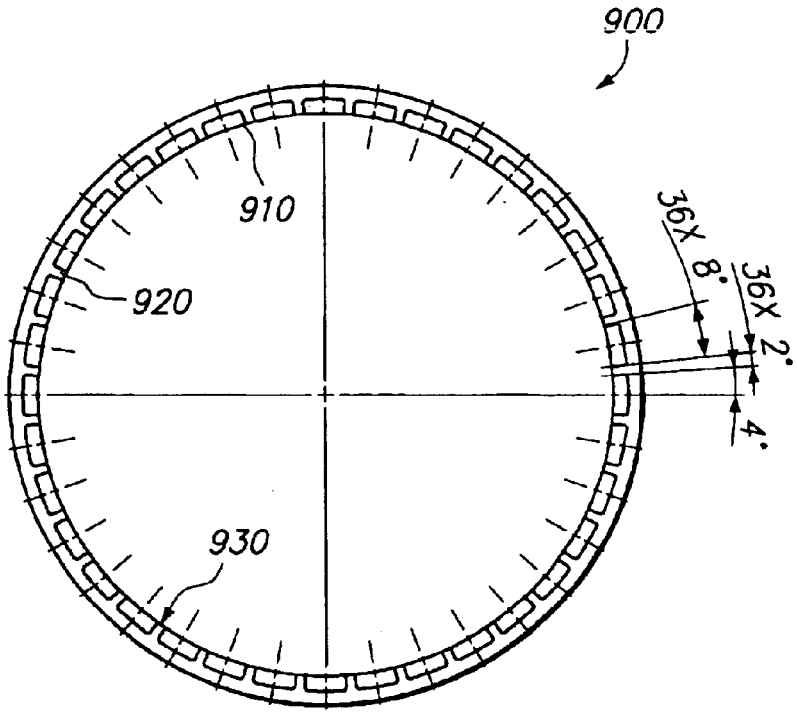
FIG. 9 is a block diagram illustrating a bottom view of a retaining ring according to a seventh embodiment of the invention.

FIG. 9 is a block diagram illustrating a bottom view of a retaining ring 900 according to a seventh embodiment of the invention. The retaining ring 900 is a cylindrically shaped structure and has an inner surface 930. Retaining ring 900 has thirty-six tips 920 each of a depth of 8 mm leaving an open region 910 for pad 110 to rebound. Tips 920 can each have a width of up to several millimeters, e.g., 20 millimeters, and a height equal to about the thickness of the acceptable wear of the retaining ring plus a height to allow the pad to rebound, or higher. The open region 910 extends radially outward from an inner surface 930 and upward from a bottom surface, thereby forming a step-like structure. The tips are spaced at intervals of about 13.85°. It will be appreciated that the tips 920 can also be spaced at uneven intervals as long as they are positioned to substantially hold in place a substrate during CMP.

Figure 10:
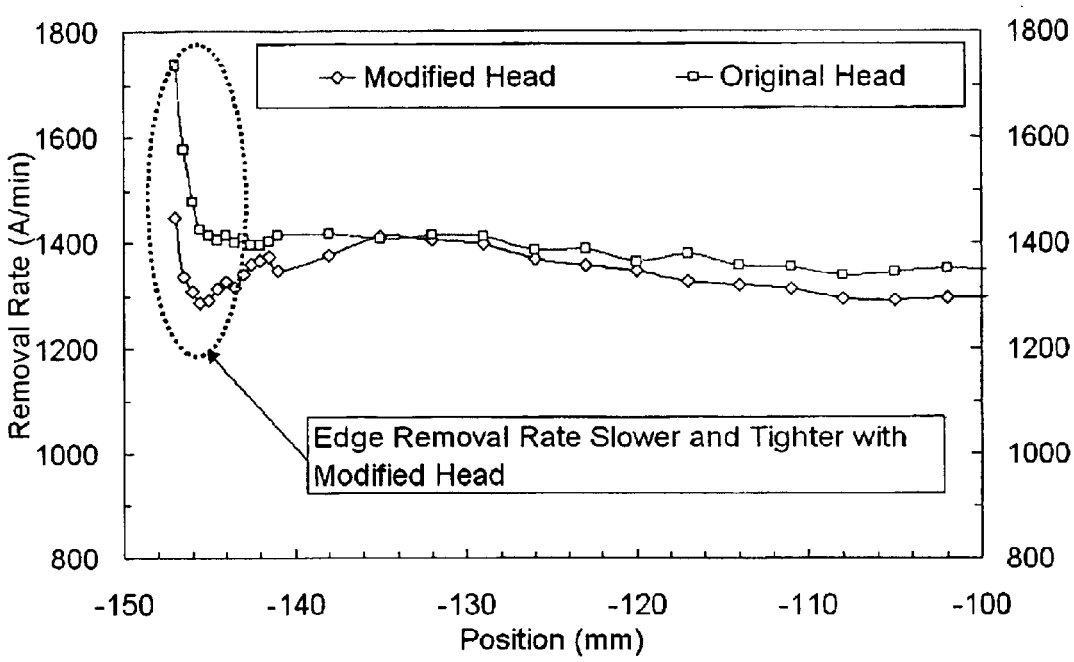
FIG. 10 is a chart showing the removal rate for a conventional retaining ring versus the retaining ring of FIG. 1B.

FIG. 10 is a chart showing the removal rate for a conventional retaining ring versus the retaining ring 120*a* (FIG. 1). Using a conventional retaining ring (also referred to as an original head) the removal rate is uneven and increases to over 1700 A/min at the edge of a substrate. In comparison, using a stepped retaining ring (also referred to as a modified head) according to an embodiment of the invention leads to a much more even removal rate over the entire substrate surface, with much less increase in removal rate at the edge of the substrate. Accordingly, using a stepped retaining ring leads to a much flatter substrate surface than conventional retaining rings.

Figure 11:
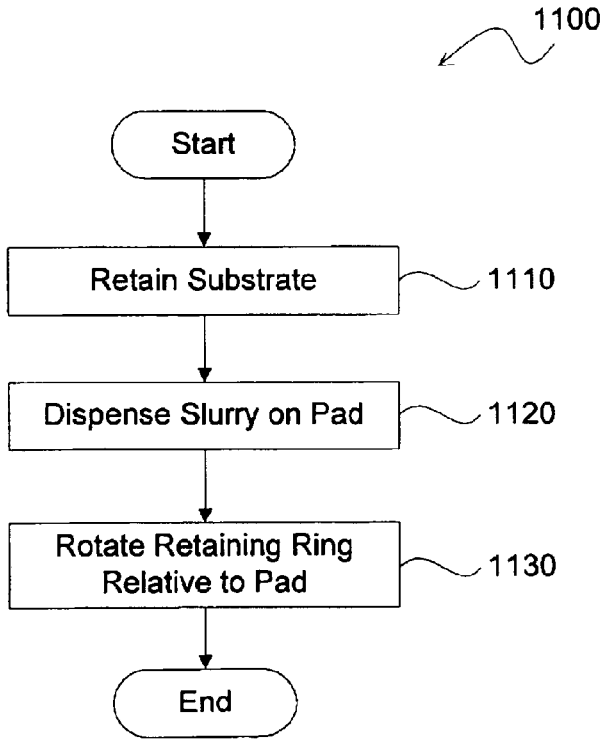
FIG. 11 is a flowchart illustrating a method for using a stepped retaining ring.

FIG. 11 is a flowchart illustrating a method 1100 for using a stepped retaining ring. The method comprises retaining (1110) a substrate with a stepped retaining ring, such as stepped retaining ring 120*a*, 120*b*, etc. Next, a slurry is dispensed (1120) onto pad 110. The slurry may include silica suspended in a mild etchant. After dispensing (1120), the retaining ring is rotated (1130) relative to pad 110. The method 1100 then ends. In another embodiment of the invention the dispensing (1120) and rotating (1130) may be done in different orders or substantially simultaneously. In another embodiment of the invention, either the retaining ring or the pad is rotated but not the both.

The foregoing description of the illustrated embodiments of the present invention is by way of example only, and other variations and modifications of the above-described embodiments and methods are possible in light of the foregoing teaching. For example, stepped retaining rings, such as retaining ring 120 may have an even or odd number of tips. Also, the polishing apparatus may be horizontal or vertical, facing up or facing down. The apparatus may include a mechanism or mechanisms to bias the substrate toward the pad. Further, the step may have rounded or curved edges. The embodiments described herein are not intended to be exhaustive or limiting. The present invention is limited only by the following claims.

What is claimed is:

1. A method comprising:

retaining a substrate with a retaining ring, the retaining ring having an inner surface capable of contacting the substrate;

a bottom surface capable of contacting a polishing pad, the bottom surface and inner surface forming a step, the step enabling the polishing pad to rebound therein during polishing, and at least three tips in the step, the at least three tips capable of retaining the substrate during polishing;

dispensing a slurry onto the polishing pad; and rotating the retaining ring against the polishing pad.

2. The method of claim 1, wherein the at least three tips are each at least about 1 mm deep.

3. The method of claim 1, wherein the at least three tips include at least two pairs of diametrically opposed tips.

4. The method of claim 1, wherein the at least three tips include an even number of tips.

5. The method of claim 1, wherein the at least three tips include an odd number of tips.

6. The method of claim 1, wherein the retaining ring further includes an outer surface, the outer surface and the bottom surface forming a second step.

7. The method of claim 6, wherein the retaining ring enables movement of slurry from the pad outside of the retaining ring to the pad within the retaining ring.

8. The method of claim 1, wherein the retaining ring has an inner diameter slightly larger than a diameter of a substrate.

9. The method of claim 1, wherein the retaining ring has an outer diameter ranging from about 30 mm to more than about 75 mm larger than the diameter of a substrate.

10. The method of claim 1, wherein the at least three tips include rounded edges.

11. The method of claim 1, the at least three tips include at least two tips that are evenly spaced.

12. The method of claim 1, the at least three tips include at least two tips that are unevenly spaced.

13. The method of claim 1, wherein the polishing includes chemical mechanical polishing.

14. A retaining ring for use in a polishing apparatus, comprising:

an inner surface capable of contacting a substrate;

a bottom surface capable of contacting a polishing pad, the bottom surface and inner surface forming a step, the step enabling the polishing pad to rebound therein during polishing; and at least three tips in the step, the at least three tips capable of retaining the substrate during polishing.

15. The retaining ring of claim 14, wherein the at least three tips are each at least about 1 mm deep.

16. The retaining ring of claim 14, wherein the at least three tips includes at least two pairs of diametrically opposed tips.

17. The retaining ring of claim 14, wherein the at least three tips includes an even number of tips.

18. The retaining ring of claim 14, wherein the at least three tips includes an odd number of tips.

19. The retaining ring of claim 14, wherein the retaining ring further includes an outer surface, the outer surface and the bottom surface forming a second step.

20. The retaining ring of claim 19, wherein the retaining ring enables movement of slurry from the pad outside of the retaining ring to the pad within the retaining ring.

21. The retaining ring of claim 14, wherein the retaining ring has an inner diameter slightly larger than a diameter of a substrate.

22.The retaining ring of claim 14, wherein the retaining ring has an outer diameter ranging from about 30 mm to more than about 75 mm larger than the diameter of a substrate.

23. The retaining ring of claim 14, wherein the at least three tips include rounded edges.

24. The retaining ring of claim 14, the at least three tips includes at least two tips that are evenly spaced.

25. The retaining ring of claim 14, the at least three tips includes at least two tips that are unevenly spaced.

26. The retaining ring of claim 14, wherein the polishing includes chemical mechanical polishing.

27. A polishing apparatus, comprising:

a polishing pad capable of polishing a substrate;

a retaining ring including an inner surface capable of contacting the substrate;

a bottom surface capable of contacting the polishing pad, the bottom surface and inner surface forming a step, the step enabling the polishing pad to rebound therein during polishing, and at least three tips in the step, the at least three tips capable of retaining the substrate during polishing, the retaining ring capable of rotating the substrate against the polishing pad; and a dispenser capable of dispensing a slurry onto the pad.

28. The apparatus of claim 27, wherein the at least three tips are each at least about 1 mm deep.

29. The apparatus of claim 27, wherein the at least three tips include at least two pairs of diametrically opposed tips.

30. The apparatus of claim 27, wherein the at least three tips include an even number of tips.

31. The apparatus of claim 27, wherein the at least three tips include an odd number of tips.

32. The apparatus of claim 27, wherein the retaining ring further includes an outer surface, the outer surface and the bottom surface forming a second step.

33. The apparatus of claim 32, wherein the retaining ring enables movement of slurry from the pad outside of the retaining ring to the pad within the retaining ring.

34. The apparatus of claim 27, wherein the retaining ring has an inner diameter slightly larger than a diameter of a substrate.

35. The apparatus of claim 27, wherein the retaining ring has an outer diameter ranging from about 30 mm to more than about 75mm larger than the diameter of a substrate.

36. The apparatus of claim 27, wherein the at least three tips each include rounded edges.

37. The apparatus of claim 27, the at least three tips include at least two tips that are evenly spaced.

38. The apparatus of claim 27, the at least three tips include at least two tips that are unevenly spaced.

39. The apparatus of claim 27, wherein the polishing includes chemical mechanical polishing.

* * * * *